United States Patent [19]

Holland et al.

[11] Patent Number: 4,895,548

[45] Date of Patent: Jan. 23, 1990

[54] COLLAPSIBLE CONSTRUCTION SET

[75] Inventors: Andrew M. Holland; Dan B. Young, both of Cincinnati; James J. Wright, Loveland, all of Ohio; Timothy M. Sullivan, Erlanger, Ky.; Hampton Woodhouse, Cincinnati, Ohio; John F. Mayer, Ft. Thomas, Ky.; Michael A. Katauskas, Cincinnati, Ohio

[73] Assignee: Tonka Corporation, Kenner Division, Minnetonka, Minn.

[21] Appl. No.: 280,233

[22] Filed: Dec. 5, 1988

[51] Int. Cl.[4] ..... A63H 3/52; A63H 33/00; E04C 3/30; B25G 3/00

[52] U.S. Cl. ..... 446/476; 446/124; 446/4; 52/726; 52/721; 52/646; 52/236.9; 182/178; 403/350; 403/334; 403/298

[58] Field of Search ..... 446/4, 6, 105, 106, 446/107, 108, 116, 121, 122, 126, 127, 124, 476, 478, 479; 52/726, 721, 646, 236.7, 236.8, 236.9, 263, 301, 298, 297, 40; 182/178; 403/350, 298, 305, 334

[56] References Cited

U.S. PATENT DOCUMENTS

| | | | |
|---|---|---|---|
| 29,607 | 8/1860 | Lytle | 52/637 |
| 198,072 | 12/1877 | Bonzano | 52/298 |
| D. 203,608 | 2/1966 | Pfister | D21/119 |
| 710,560 | 10/1902 | Bonn | 446/6 |
| 880,943 | 5/1908 | Weisenbach et al. | 446/180 |
| 964,233 | 7/1910 | Gilliland | 52/637 |
| 1,799,314 | 4/1931 | Pfaff | 52/298 |
| 1,931,734 | 10/1933 | Levy | 446/426 |
| 1,951,263 | 3/1934 | Anzlovar | 446/424 |
| 2,442,526 | 6/1948 | Wright | 446/476 X |
| 2,457,653 | 12/1948 | Froelich | 446/4 |
| 2,561,481 | 7/1951 | Rody | 446/168 X |
| 2,677,813 | 5/1954 | Sharp | 403/350 X |
| 2,923,122 | 2/1960 | Inman | 446/168 X |
| 2,927,396 | 4/1961 | Hall, Jr. | 446/115 |
| 2,975,779 | 5/1961 | Pope | 124/64 |
| 3,040,475 | 6/1962 | Reed et al. | 446/231 |
| 3,162,440 | 12/1964 | Angiro | 446/193 X |
| 3,168,793 | 2/1965 | Gibson | 446/127 |
| 3,266,255 | 8/1966 | Dougherty | 52/726 X |
| 3,304,113 | 2/1967 | Hutchinson | 294/1.2 |
| 3,378,971 | 4/1968 | Singer et al. | 52/283 X |
| 3,471,147 | 10/1969 | Glass et al. | 273/1 R |
| 3,492,757 | 2/1970 | Balthazor | 446/426 |
| 3,589,724 | 6/1971 | Barlow et al. | 446/138 X |
| 3,835,612 | 9/1974 | Beziat | 52/646 X |
| 3,899,169 | 8/1975 | Rhodes et al. | 446/85 X |
| 4,086,902 | 5/1978 | Reynolds | 124/61 |
| 4,488,373 | 12/1984 | Glickson | 446/4 |
| 4,571,197 | 2/1986 | Kulesza et al. | 446/6 |
| 4,571,200 | 2/1986 | Serna | 52/263 |
| 4,661,080 | 8/1987 | Goldstein et al. | 446/4 |
| 4,723,384 | 2/1988 | Mengerinhausen et al. | 52/637 X |

FOREIGN PATENT DOCUMENTS

| | | | |
|---|---|---|---|
| 2262246 | 12/1972 | Fed. Rep. of Germany | 446/476 |
| 897429 | 7/1943 | France . | |
| 1492420 | 8/1967 | France | 403/189 |
| 655184 | 1/1963 | Italy . | |
| 996443 | 3/1965 | United Kingdom . | |
| 2012601 | 8/1979 | United Kingdom | 446/4 |

*Primary Examiner*—Robert A. Hafer
*Assistant Examiner*—D. Neal Muir
*Attorney, Agent, or Firm*—Marshall, O'Toole, Gerstein, Murray & Bicknell

[57] ABSTRACT

A collapsible construction set comprises a plurality of parts, each of which includes at least one integrally formed connector. A plurality of connector designs are provided. A first design includes a tapered receptacle and a stabilizing pin at the center of the receptacle. A second design includes a tapered end which fits in the receptacle and a hole which receives the stabilizing pin. A third design includes a ledge which forms a recess, and a fourth design includes a hook which engages the ledge and extends into the recess. The ledge of the third design is preferably formed adjacent the receptacle of the first design, and the second design preferably also includes at least one flange which overlies and holds a hook of the fourth design. To dismember the parts of a structure, a tapered end is moved out of the tapered receptacle until the stabilizing pin disengages from the hole, and then all of the parts of the structure topple.

2 Claims, 3 Drawing Sheets

FIG. 6
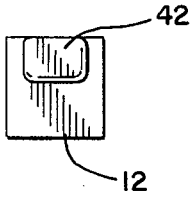
FIG. 8
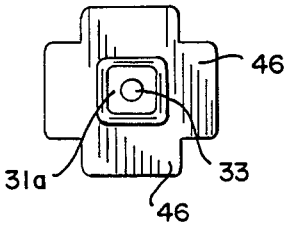
FIG. 7
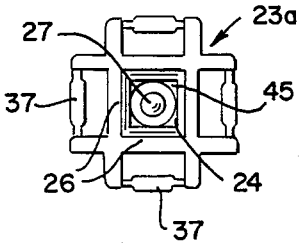
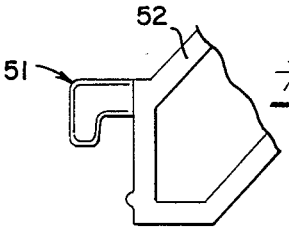
FIG. 9
FIG. 10
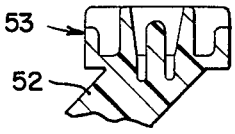
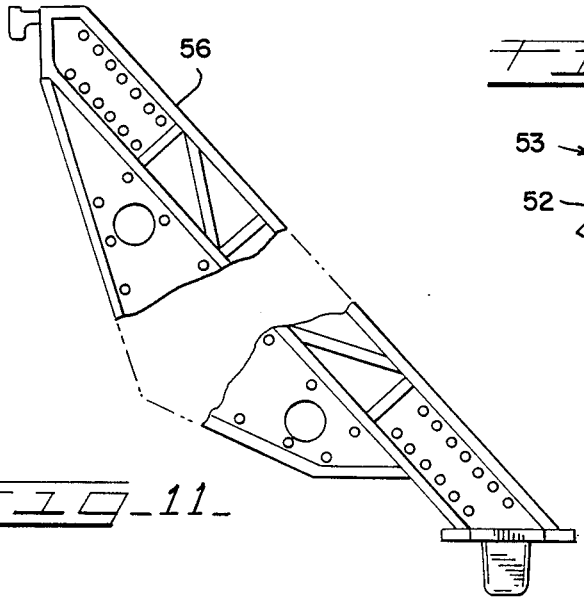
FIG. 11

COLLAPSIBLE CONSTRUCTION SET

FIELD AND BACKGROUND OF THE INVENTION

This invention relates generally to a toy construction set and more particularly to a construction set wherein the parts may be assembled to form a structure and then the structure may be quickly toppled or collapsed.

There have been numerous types of toy construction sets which have been marketed over the years. Such sets include a variety of parts which may be assembled to form different structures, such as buildings, bridges, etc. Normally fasteners are included in the sets for connecting the parts together, and the fasteners may be separate members such as screws and nuts or they may be integral with the parts as shown in the H. Gibson U.S. Pat. No. 3,168,793, which shows a set wherein the fasteners are integrally formed on the ends of columns and beams.

Construction sets have also been provided which are designed to be quickly toppled or dismembered. The C. T. Bonn U.S. Pat. No. 710,560 shows a "Knockdown Toy Battle-Ship" formed by a number of stackable parts which are designed to be "progressively dismembered by a projectile from a toy cannon". The D. A. Glickson et al. U.S. Pat. No. 4,488,373 describes a "Stackable Piece Playset" which may be toppled by operation of a detonator box.

The toy construction sets described in the foregoing Bonn and Glickson et al. patents are unsatisfactory in that when the parts are assembled to form structures, the structures appear to have little stability and may topple unintentionally. The parts of the set shown in the Gibson patent, on the other hand, appear to have good stability but not easily toppled.

It is a general object of this invention to provide a construction set wherein a structure formed by the parts of the set has good stability but may also be readily dismembered on command.

SUMMARY OF THE INVENTION

A set in accordance with the present invention comprises a plurality of parts, each of which includes at least one integrally formed connector, and a plurality of connector designs are provided. A first design includes a tapered receptacle and a stabilizing pin at the center of the receptacle. A second design includes a tapered end which fits in the receptacle and a hole which receives the stabilizing pin. A third design includes a ledge which forms a recess, and a fourth design includes a hook which engages the ledge and extends into the recess. The ledge of the third design is preferably formed adjacent the receptacle of the first design, and the second design preferably also includes at least one flange which overlies and holds a hook of the fourth design.

To dismember the parts of a structure, a tapered end is moved out of the tapered receptacle until the stabilizing pin disengages from the hole, and then all of the parts of the structure topple.

BRIEF DESCRIPTION OF THE DRAWINGS

The invention will be better understood from the following detailed description taken in conjunction with the accompanying figures of the drawings, wherein:

FIG. 6 is an end view taken on the line 6—6 of FIG. 3;

FIG. 7 is an end view taken on the line 7—7 of FIG. 3;

FIG. 8 is an end view taken on the line 8—8 of FIG. 3; and

FIGS. 9, 10, and 11 are views of other construction set parts including connectors in accordance with the invention.

DETAILED DESCRIPTION OF THE DRAWINGS

Figure 1:
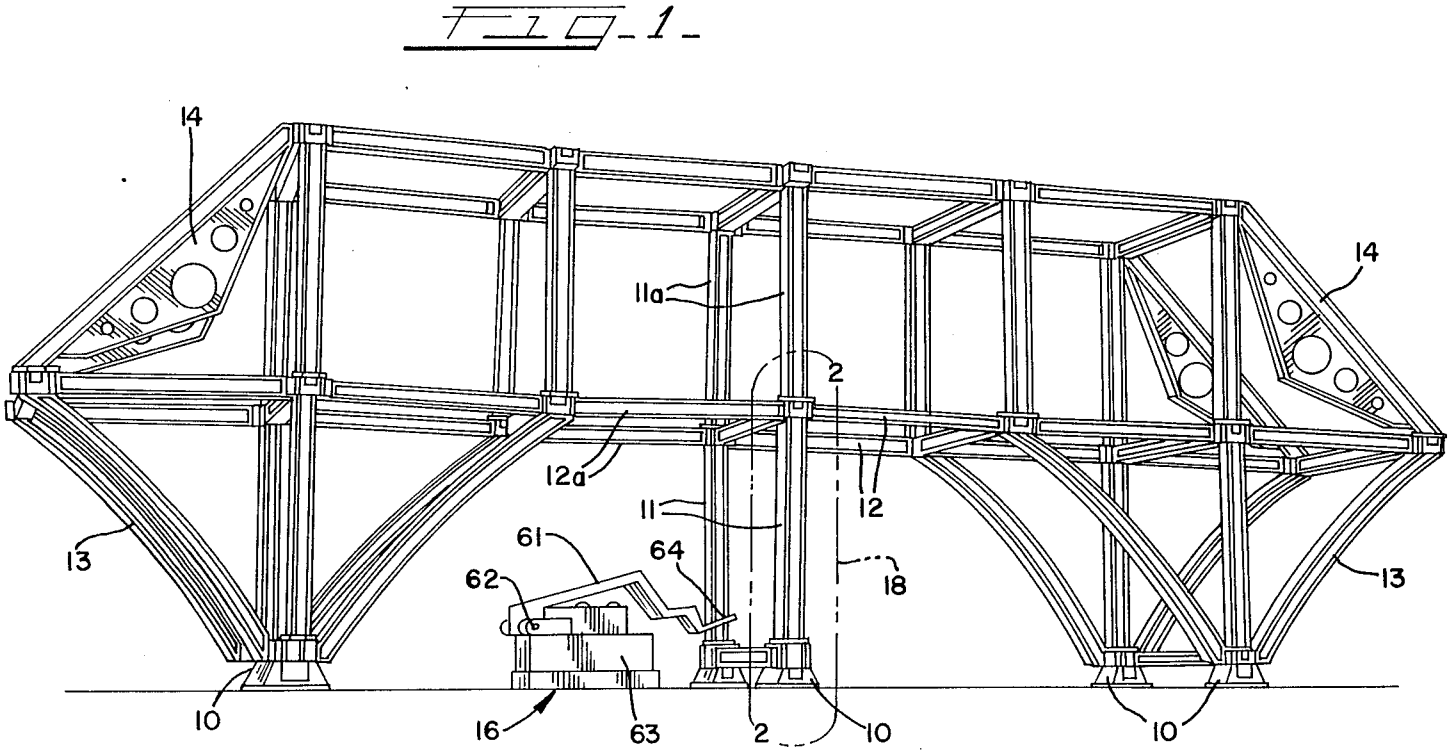
FIG. 1 is a perspective view of a structure formed by parts in accordance with the present invention.

FIG. 1 illustrates a specific example of a structure formed by construction parts in accordance with the present invention. In this example, the structure is a bridge, and the construction parts include a plurality of bases 10, vertical columns 11 and 11*a*, horizontal beams 12 and 12*a*, and diagonal members 13 and 14. Each of the parts 10, 11, 12, 13 and 14 includes connectors at its ends constructed in accordance with the present invention and illustrated in detail in FIGS. 2 through 11. The construction set preferably further includes a detonator 16 for causing the bridge structure shown in FIG. 1 to topple or detonate quickly on the command of a person playing with the construction set, such a detonator, of course, serving to enhance the play value of the construction set.

Figure 2:
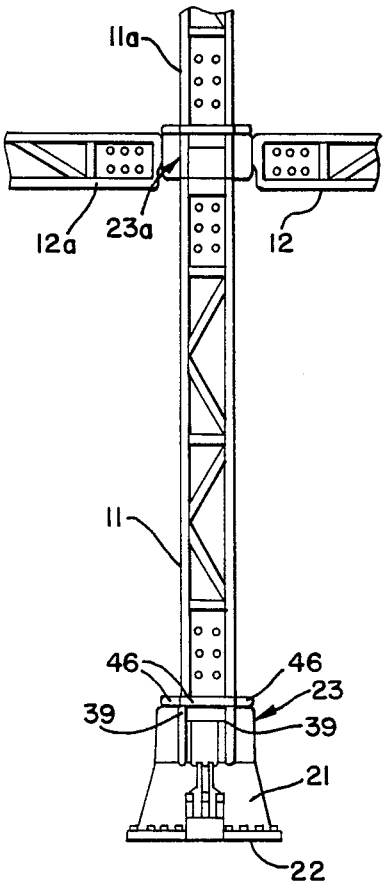
FIG. 2 is a fragmentary enlarged view of the portion of the structure indicated in dashed lines in FIG. 1.
Figure 3:
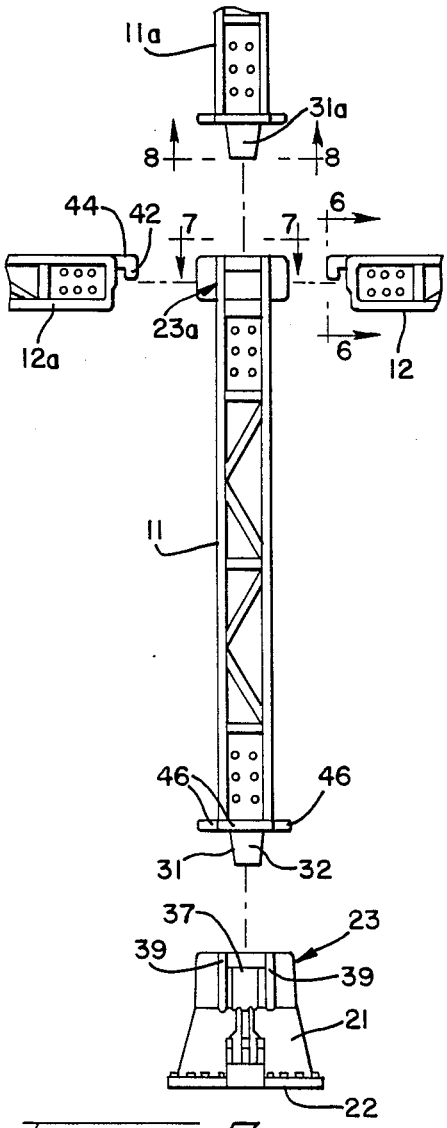
FIG. 3 is an exploded view of the structure shown in FIG. 2.
Figure 5:
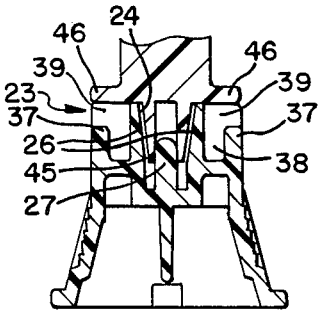
FIG. 5 is an enlarged fragmentary view partially in section of another portion of the structure shown in FIG. 2.

FIGS. 2 and 3 further illustrate the portion of the bridge structure within the dashed lines 18 (see FIG. 1) and shows the connectors at the ends of the parts. The base 10 includes a generally cubical outer wall 21 having a flat bottom side 22 which is adapted to be placed on a support surface such as a floor or table. On the topside of the base 10 is provided a receptacle connector 23 which has a square-shaped (in cross section) receptacle 24 formed in it. The receptacle connector 23 on the base 10 is essentially identical with a receptacle connector 23*a* on the upper end of the column 11 and is also illustrated in FIG. 7. The walls 26 forming the receptacle 24 are tapered such that the receptacle 24 increases in width in the upward direction. At the center of the receptacle 24 is formed a stabilizing pin 27 which is centrally located between the four tapered walls 26 and extends generally parallel to the walls. As shown in FIG. 5, the upper end of the pin 27 is substantially lower than the upper edges of the receptacle walls 26. Length of pin 27 may be increased to gain more stability in certain pieces and structures.

On the bottom end of the column 11 is formed a tapered end connector which mates or connects with the receptacle connector 23. The tapered end connector includes a substantially square (in cross section) projection 31 (see also FIG. 8) formed by four slanted walls 32. The tapers or slants of the four walls 32 match the slants of the walls 26 of the receptacle 24 so that the projection 31 may be received within the receptacle 24. A hole 33 is formed at the center of the projection 31 and extends generally parallel to the walls 32, the hole 33 being located to receive the stabilizing pin 27 when the end 31 is inserted into the receptacle 24.

Stop means is provided for preventing the tapered projection 31 from seating tightly within the tapered receptacle 24, and for forming a narrow clearance space between the walls 26 and 32. The stop means may be formed by the undersides of flanges 46 which engage the upper ends of the walls 26 or be formed by a seat 45 formed adjacent the bottom of the receptacle 24, the lower end of the projection 31 being engageable with the seat 45. Either type of stop means prevents the tapered end connector from seating tightly within the tapered receptacle connector but allows the stabilizing pin 27 to extend into the hole 33.

Figure 4:
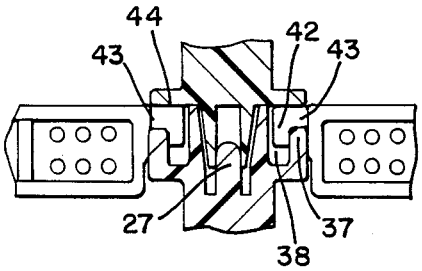
FIG. 4 is an enlarged view partially in section of a portion of the structure shown in FIG. 2.

Around the receptacle connector is provided four walls which form ledges 37 that are adjacent and parallel with the walls 26. As best shown in FIGS. 3, 4 and 5, the upper ends of the ledges 37 are displaced downwardly from the upper ends of the walls 26 which form the receptacle, and a recess 38 is formed between each ledge 37 and the adjacent parallel wall 26. Side walls 39 are formed at the sides of each ledge 37, the side walls 39 extending upwardly to the upper level of the walls 26 as shown in FIG. 5.

Extending transversely of the column 11 are beams 12 and 12*a*. Each beam has a hook connector formed on at least one end, the hook connector including a right angle hook 42 which extends perpendicularly to the length of the beam. The thickness of the hook 42 is slightly less than the width of the recess 38, and the sideways dimension of the hook 42 is such that it fits closely between the two side walls 39 at the ends of the ledge 37. Further, the portion 43 of the beam 41, which is at the throat of the hook, has a vertical height which is such that the upper side 44 of the hook is substantially flush with the upper ends of the walls 26 and the upper ends of the side walls 39, as illustrated in FIG. 4.

Further, the tapered end connector at the lower end of a column includes laterally extending flanges 46 which extend laterally outwardly from the walls 32 and the lengthwise dimension of the column 11. The flanges 46 are located at the upper ends of the tapered walls 32, and the flanges 46 rest on the upper ends of the walls 26 and 39 of the receptacle connector when the tapered end 31 is inserted into the receptacle 24. It will also be noted from FIG. 4 that the flanges 46 overlie the upper sides 44 of the hooks 42, whereby the hooks 42 cannot be moved upwardly off of the ledges 37 while the column 11 is held assembled with the crown 23. Further, as previously mentioned, the lateral sides of the hooks 42 engage the side walls 39 when the hook is assembled in a recess 38. As a consequence, the flanges 46 prevent upward movement of the hook and the side walls 39 prevent substantial lateral movement of the hook, thereby providing a degree of stability between a beam 41 and the receptacle connector.

With reference again to FIGS. 2 and 3, it will be noted that the upper end of the column 11 includes a tapered receptacle connector similar to that of the base, and that the lower end of the upper column 11*a* includes a tapered end connector similar to that at the lower end of the lower column 11. By this arrangement, a series of columns may be stacked vertically and connected by inserting the tapered end connectors into the tapered receptacle connectors. Further, at each of the tapered receptacle connectors, up to four beams having hook connectors may be attached to the ledges 37 and the flanges 46 of the tapered end connectors overlie the hook connectors and restrain withdrawal of the hook connectors from the recess connectors.

FIGS. 2 through 8 illustrate construction parts and connectors wherein the construction parts extend either in end-to-end relation or in transverse relation. The parts illustrated in FIGS. 9, 10 and 11, on the other hand, are designed to extend at 45° angles to a vertical column and to a horizontal beam, for example. With specific reference to FIG. 9, a hook type connector 51 similar to that shown in FIGS. 3 and 4 is shown formed on an end of a construction part 52, and the hook connector 51 is set at a 45° angle relative to the length of the part 52. Similarly at the other end of the part 52, a tapered receptacle connector 53 is shown in FIG. 10, this connector 53 also being formed at a 45° angle. This arrangement may be referred to as a 45° bottom hook, top receptacle part. FIG. 11 shows the reverse arrangement wherein a 45° hook up, receptacle down connector on a part 56 is provided. The parts 52 and 56 illustrated in FIGS. 9 through 11 may be utilized similar to the parts 13 and 14 shown in FIG. 1.

The detonator 16 comprises an arm 61 which is pivotably mounted by a pin 62 on a base 63. The base 63 includes a pneumatic or mechanical arrangement for moving the arm 61 upwardly on the axis of the pin 62. For example, a pneumatic device including a piston in a cylinder may be provided in the base 63 wherein the piston or the cylinder is connected to push the arm 61 upwardly in response to an air pulse received in the cylinder. The air pulse may be received through a tube from a command piston-cylinder arrangement (not illustrated), the arrangement being such that when a person playing with the set presses on the command piston, an air pulse travels through the tube and to the slave cylinder in the base 63, thereby causing the arm 61 to swing upwardly. The outer end 64 of the arm 61 is engageable with a part of the structure shown in FIG. 1 such as a lower beam 12. When the detonator 16 is actuated, the arm 61 lifts the beam 12 slightly. This causes the hook 42 to move upwardly and lift the associated flange 46, which in turn moves the receptacle connector up and causes the stabilizing pin 27 to disengage from the hole 33 of the tapered end connector. Without the stability provided by the pin 27 in the hole 33, because of the increased size of the gap or space between the walls 26 and 32 (due to the taper of the walls), the coupling between the receptacle and end connectors becomes unstable. If the length of pin 27 is increased to provide additional stability the receptacle connector must be moved up a greater distance to cause the coupling between the receptacle and end connectors to become unstable. The column 11 tips and the entire structure immediately collapses. Up until this time, however, the structure has good stability and may be added onto, played with and moved laterally somewhat by a person playing with the set without disturbing the structural integrity of the set.

While a limited number of parts have been illustrated, it will be understood that a variety of designs such as additional shapes of columns, beams, etc. may be provided, having hook and ledge types of connectors as well as tapered end and tapered receptacle types of connectors as illustrated and described herein. The construction set parts are preferably molded from a relatively rigid plastic.

It will be apparent from the foregoing that an improved construction set has been provided. The parts may be assembled to form a variety of structures, and the connectors between the parts have sufficient stability that the structure has play value while standing. If desired, the structure may be quickly toppled (to simulate, for example, a demolition) using a detonator or by hand. The connections between the tapered ends and the tapered receptacles are sufficiently loose that the ends may easily be lifted out of the receptacles but the connections between the stabilizing pins and the mating holes normally maintain the structural integrity of the assembly. The structure is toppled by lifting a part enough to move the stabilizing pins out of the holes and to increase the looseness of the coupling between the tapered ends and receptacles. Disconnection of one or two connectors as described above causes the entire structure to collapse.

What is claimed is:

1. A toy construction set comprising first, second and third parts, said first part including a receptacle connector formed by receptacle walls, said receptacle walls forming an open receptacle therebetween, said first part further including a stabilizing pin in said open receptacle and generally parallel with said receptacle walls, and at least one ledge on said receptacle connector adjacent and outside of said receptacle walls, said second part including an end connector formed by an end which is insertable into said receptacle, said end having a hole therein for receiving said stabilizing pin, said end connector further including at least one flange which extends generally laterally of said end and is operable to overlie said ledge when said receptacle and end connectors are assembled, and said third part including a hook connector formed by a generally right angle hook, said hook being engageable with said ledge, and said hook extending between said ledge and said flange when said receptacle, end and hook connectors are assembled, said third part having a hook connector and an end connector at ends thereof.

2. A toy construction set as set forth in claim 1, wherein said third part further includes an elongated portion between said ends thereof, and said hook and end connectors are oriented at substantially 45° angles relative to said elongated portion.

* * * * *